US008708739B2

(12) United States Patent
Takeda et al.

(10) Patent No.: US 8,708,739 B2
(45) Date of Patent: Apr. 29, 2014

(54) CONNECTOR

(75) Inventors: Kazuaki Takeda, Yokkaichi (JP); Daiki Hatayama, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 31 days.

(21) Appl. No.: 13/495,106

(22) Filed: Jun. 13, 2012

(65) Prior Publication Data

US 2013/0012042 A1 Jan. 10, 2013

(30) Foreign Application Priority Data

Jul. 6, 2011 (JP) ..... 2011-149625

(51) Int. Cl.
*H01R 13/40* (2006.01)

(52) U.S. Cl.
USPC ..... 439/595; 439/752

(58) Field of Classification Search
USPC ..... 439/595, 603, 744, 752
See application file for complete search history.

(56) References Cited

U.S. PATENT DOCUMENTS

| | | | | |
|---|---|---|---|---|
| 5,145,356 | A * | 9/1992 | Minnis | 439/352 |
| 5,928,034 | A * | 7/1999 | Tabata et al. | 439/595 |
| 6,159,047 | A * | 12/2000 | Tanaka | 439/595 |
| 6,416,365 | B1 * | 7/2002 | Iwahori | 439/752 |
| 7,140,908 | B2 * | 11/2006 | Katsuma | 439/489 |
| 2003/0027455 | A1 | 2/2003 | Yamawaki et al. | |
| 2005/0255740 | A1 | 11/2005 | Katsuma | |

FOREIGN PATENT DOCUMENTS

| | | |
|---|---|---|
| DE | 19651684 | 6/1997 |
| JP | 08106952 | 9/1994 |
| JP | 9-73936 | 3/1997 |

* cited by examiner

*Primary Examiner* — Hien Vu
(74) *Attorney, Agent, or Firm* — Gerald E. Hespos; Michael J. Porco; Matthew T. Hesops

(57) ABSTRACT

A connector (10M; 10M) is provided with a front wall (26F; 26M) arranged to face the front end of a housing (11F; 11M), a front retainer (25F; 25M) including detecting portions (27F; 27M) to be fit into deformation spaces (14F; 14M) in an assembled state, and restrictions (41F, 42F, 43F, 44F; 41M, 42M, 43M, 44M) for restricting relative displacements of the housing (11F; 11M) and the front retainer (25F, 25M) in a direction crossing an assembling direction.

9 Claims, 14 Drawing Sheets

CONNECTOR

BACKGROUND OF THE INVENTION

1. Field of the Invention

The invention relates to a connector.

2. Description of the Related Art

Japanese Unexamined Patent Publication No. H09-73936 discloses a connector with a housing and a retainer assembled into the housing from the front. A cavity is formed in the housing and a terminal fitting can be inserted into the cavity. A locking lance is formed in the housing and projects into an insertion path for the terminal fitting. The locking lance is deformed resiliently and retracted out of the insertion path in the process of inserting the terminal fitting. However, the locking lance resiliently returns to retain the terminal fitting when the terminal fitting is inserted properly in the cavity. A deformation space is open on the front surface of the housing and allows resilient deformation of the locking lance. The front retainer has a front wall that covers the front surface of the housing in an assembled state and a detecting portion that fits in the deformation space in the assembled state.

The housing may be displaced relative to the front retainer in a direction crossing an assembling direction. Abnormal noise is produced due to a shaky movement of the front retainer. Further, a tab of a male terminal fitting that penetrates through the front wall may be displaced if the front wall of the front retainer is displaced and hence a contact pressure between the tab and the female terminal fitting may become unstable.

The invention was completed in view of the above situation and an object of the invention is to prevent a problem caused by relative displacements of a housing and a front retainer.

SUMMARY OF THE INVENTION

The invention relates to a connector that has a housing with at least one cavity and at least one terminal fitting to be inserted into the cavity from behind. At least one locking lance is formed in the housing adjacent an insertion path for the terminal fitting. The locking lance is deformed resiliently and retracts from the insertion path for the terminal fitting in the process of inserting the terminal fitting. However, the locking lance resiliently returns to retain the terminal fitting that has been inserted properly into the cavity. At least one deformation space is open at the front of the housing and allows deformation of the locking lance. A front retainer is assembled to the housing from the front. The retainer has a front wall that faces the front of the housing in an assembled state and at least one defines detecting portion that fits into the deformation space in the assembled state. Restrictions are formed on the housing and the front retainer and contact one another to restrict relative displacements of the housing and the front retainer in a direction crossing the assembling direction. Thus, the restrictions prevent problems caused by relative displacements of the housing and the front retainer.

The terminal fitting preferably is a female terminal fitting including a rectangular or polygonal tube for accommodating a tab of a mating terminal fitting.

A projection may project forward from the front surface of the housing where the cavity is open. The projecting end surface of the projection is a reference surface in setting dimensions of the housing. The restrictions preferably are formed on an inner surface of the projection and an outer surface of the front wall. Thus, the shape of the housing can be simplified as compared with the case where the restriction is on a special part different from the projection.

The terminal fitting may be a male terminal fitting with a tab at the front end. The housing may be formed with a receptacle that at least partly surrounds the tab.

The restrictions may be on an inner surface of the receptacle and an outer surface of the front wall. Thus, the shape of the housing can be simplified as compared with the case where the restriction is on a special part different from the receptacle.

The restrictions may be formed on a surface of the deformation space substantially facing the locking lance and an outer surface of the detecting portion substantially opposite the locking lance.

The restrictions are formed on the existing deformation space and detecting portion utilizing a structure of fitting the detecting portion into the deformation space for allowing resilient deformation of the locking lance. Accordingly, the shapes of the housing and the front retainer can be simplified as compared with the case where the restrictions are formed on special parts different from the deformation space and the detecting portion.

The locking lance preferably is displaced in a direction to increase an engagement margin with the terminal fitting by the contact of the restrictions in the process of fitting the detecting portion into the deformation space. Therefore, reliability of retaining the terminal fitting by the locking lance is improved.

Front end parts of the respective restricting portions are formed with at least one guiding surface aligned oblique to the assembling direction of the front retainer.

These and other objects, features and advantages of the present invention will become more apparent upon reading of the following detailed description of preferred embodiments and accompanying drawings.

DETAILED DESCRIPTION OF THE PREFERRED EMBODIMENTS

A connector assembly of this embodiment is composed of a female connector 10F and a male connector 10M that are connectable to each other.

Figure 1:
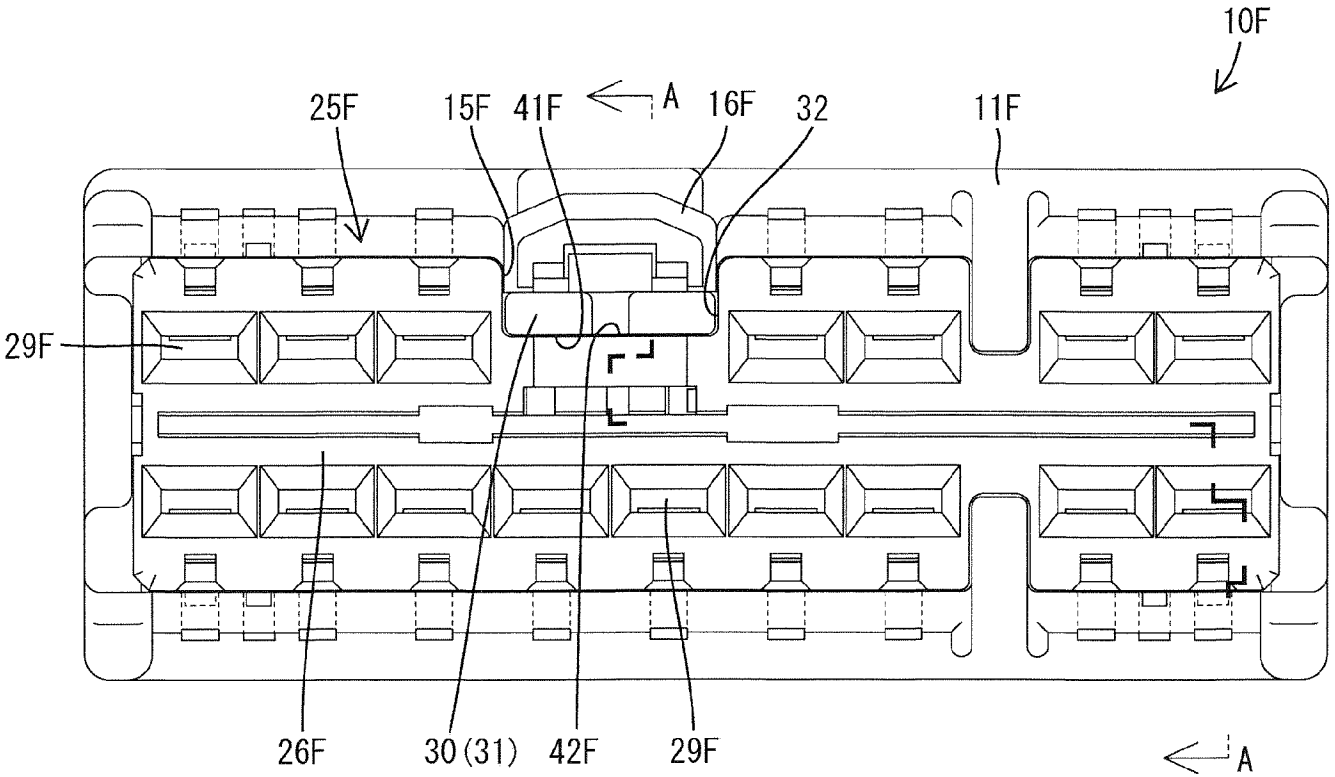
FIG. 1 is a front view of a female connector of an embodiment.
Figure 2:
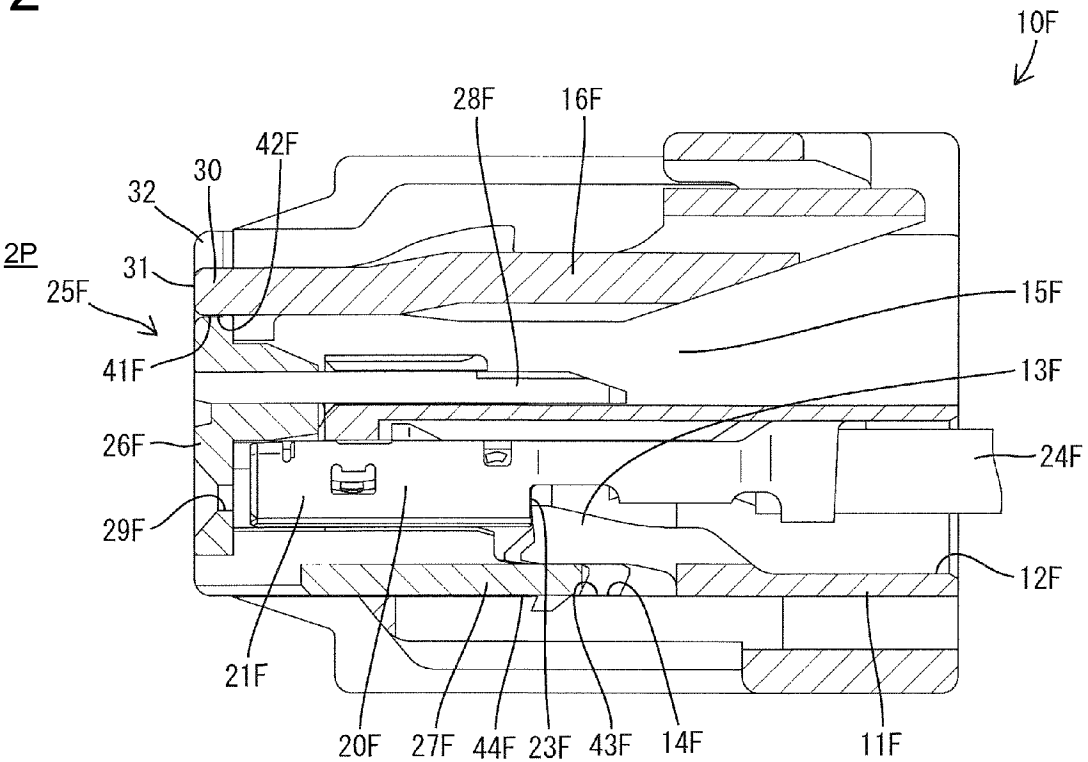
FIG. 2 is a section along A-A of FIG. 1 showing a state where a female front retainer is fully locked in a female housing.
Figure 3:
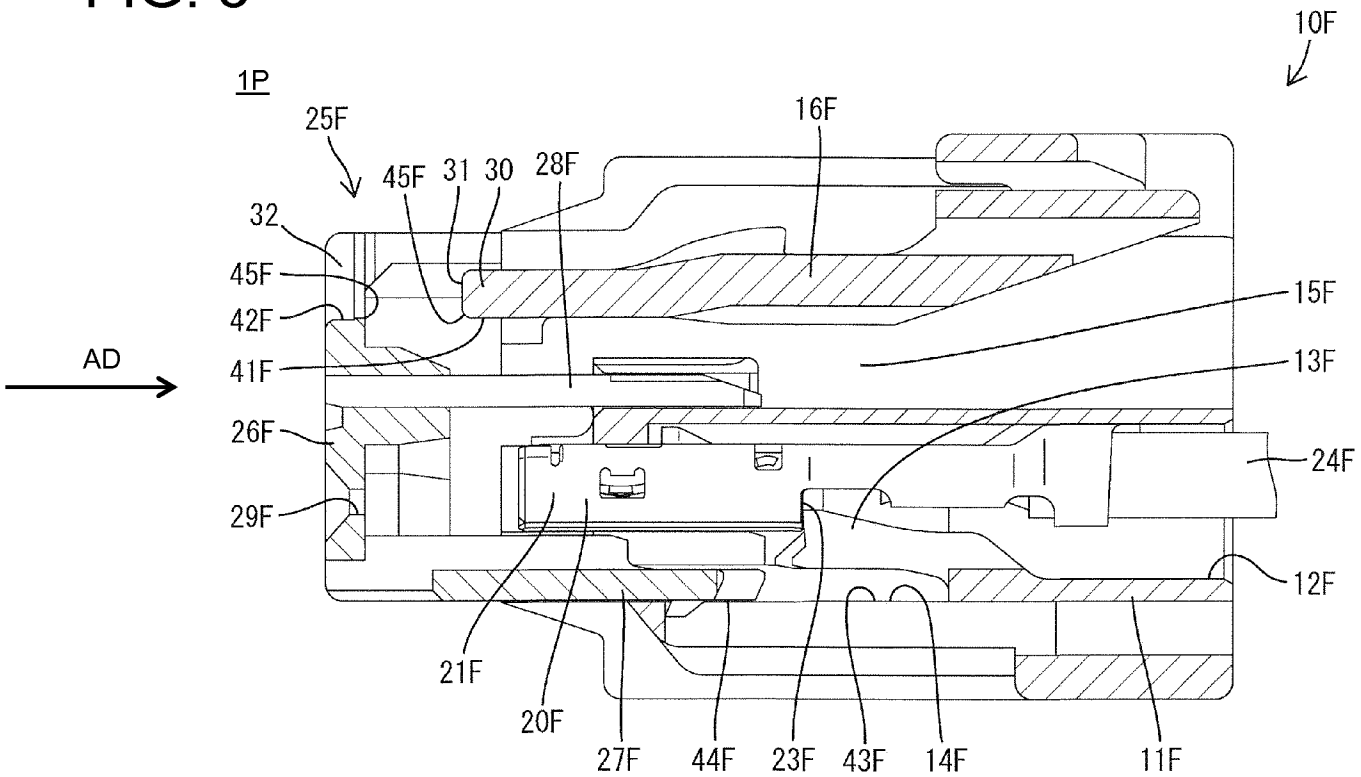
FIG. 3 is a section along A-A of FIG. 1 showing a state where the female front retainer is partly locked in the female housing.

As shown in FIGS. 2 and 3, the female connector 10F is formed by assembling a female housing 11F made e.g. of synthetic resin, female terminal fittings 20F and a female front retainer 25F made e.g. of synthetic resin.

The female housing 11F is substantially in the form of a block. Cavities 12F penetrate through the female housing 11F in forward and backward directions and at upper and lower stages or levels, as shown in FIGS. 2 and 3. A locking lance 13F is cantilevered forward along an upper wall of each cavity 12F in the upper level. A deformation space 14F is defined above the locking lance 13F in the upper level in the female housing 11F to allow the locking lance 13F to be deformed resiliently up and out of an insertion path for the female terminal fitting 20F in the cavity 12F. On the other hand, a locking lance 13F is cantilevered forward along a lower wall of each cavity 12F in the lower level. A space below the locking lance 13F in the lower level in the female housing 11F defines a deformation space 14F for allowing the locking lance 13F to be deformed resiliently down and out of an insertion path for the female terminal fitting 20F in the cavity 12F. The deformation spaces 14F are open at the front of the female housing 11F.

Figure 4:
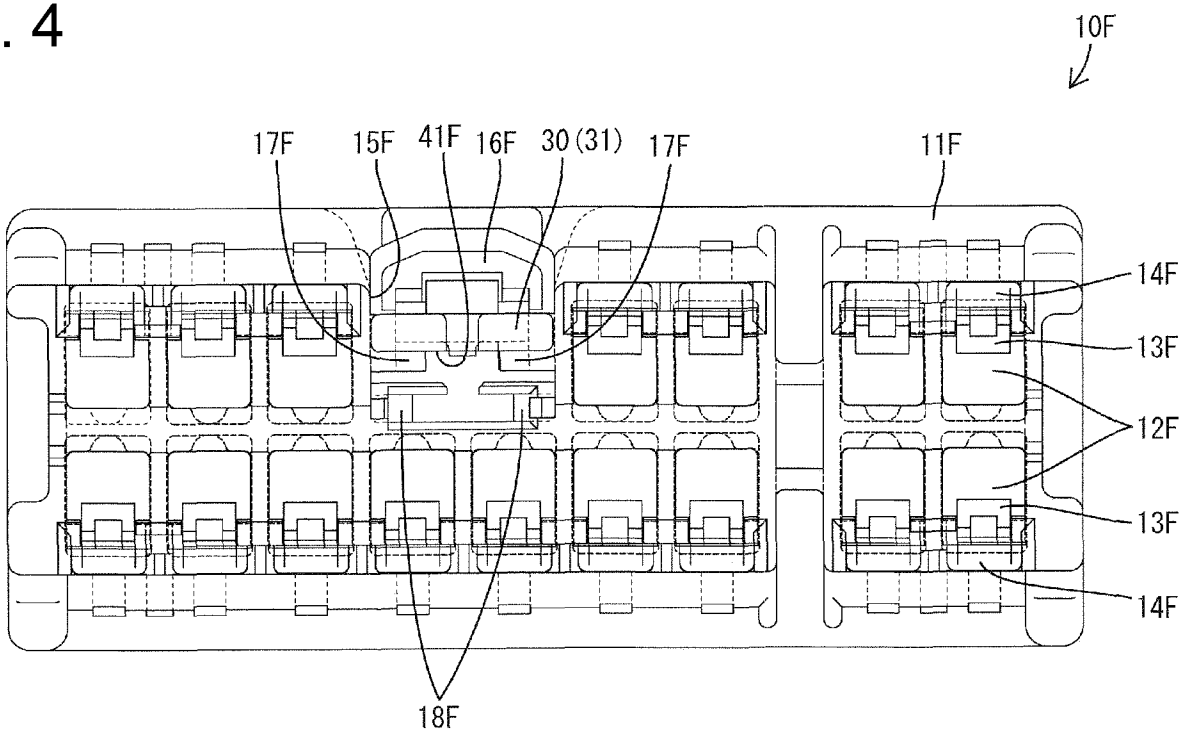
FIG. 4 is a front view of the female housing.

An accommodation recess 15F is formed at a laterally intermediate position of the upper surface of the female housing 11F, as shown in FIGS. 2 and 3, and is open at both front and rear ends of the female housing 11F. As shown in FIG. 4, the formation range of the accommodation recess 15F in a vertical direction substantially corresponds to the cavities 12F in the upper level. A lock arm 16F is provided in the accommodation recess 15F for locking the female housing 11F and a male housing 11M in a connected state. As shown in FIG. 4, the lock arm 16F is long in forward and backward directions and is connected to left and right inner walls of the accommodation recess 15F via left and right couplings 17F at a front part of the lock arm 16F. The lock arm 16F normally is held at a lock position by the rigidity of the couplings 17F, but is resiliently deformable to an unlocking position located below with the couplings 17F. Locking portions 18F are formed in an area of the accommodation recess 15F below the lock arm 16F for holding the female front retainer 25F at a partial locking position and a full locking position.

As shown in FIGS. 2 and 3, the female terminal fitting 20F is long and narrow in forward and backward directions. A substantially rectangular tube 21F is formed at a front end of the female terminal fitting 20F and a resilient contact piece is provided in the tube 21F. A retaining portion 23F is defined at the rear edge of the tube 21F to be engaged with the locking lance 13F. A wire 24F is to be connected to a rear part of the female terminal fitting 20F e.g. by crimping or soldering. The female terminal fitting 20F is inserted into the cavity 12F from behind so that the tube 21F pushes the locking lance 13F and deforms the locking lance 13F toward the deformation space 14F. The locking lance 13F resiliently returns when the female terminal fitting 20F reaches a proper insertion position and engages the retaining portion 23F to hold the female terminal fitting 20F.

Figure 5:
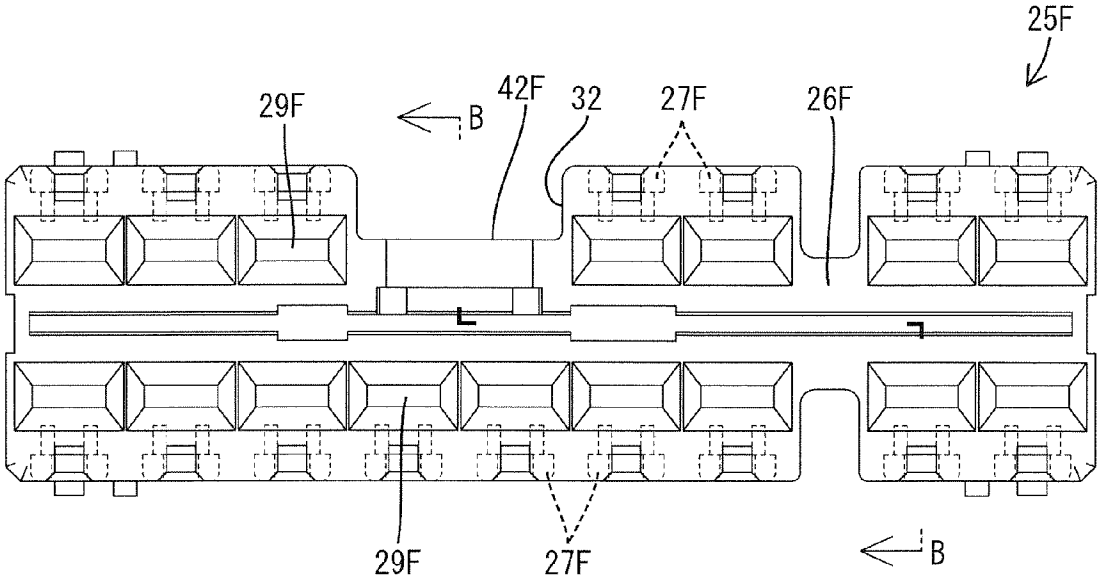
FIG. 5 is a front view of the female front retainer.
Figure 6:
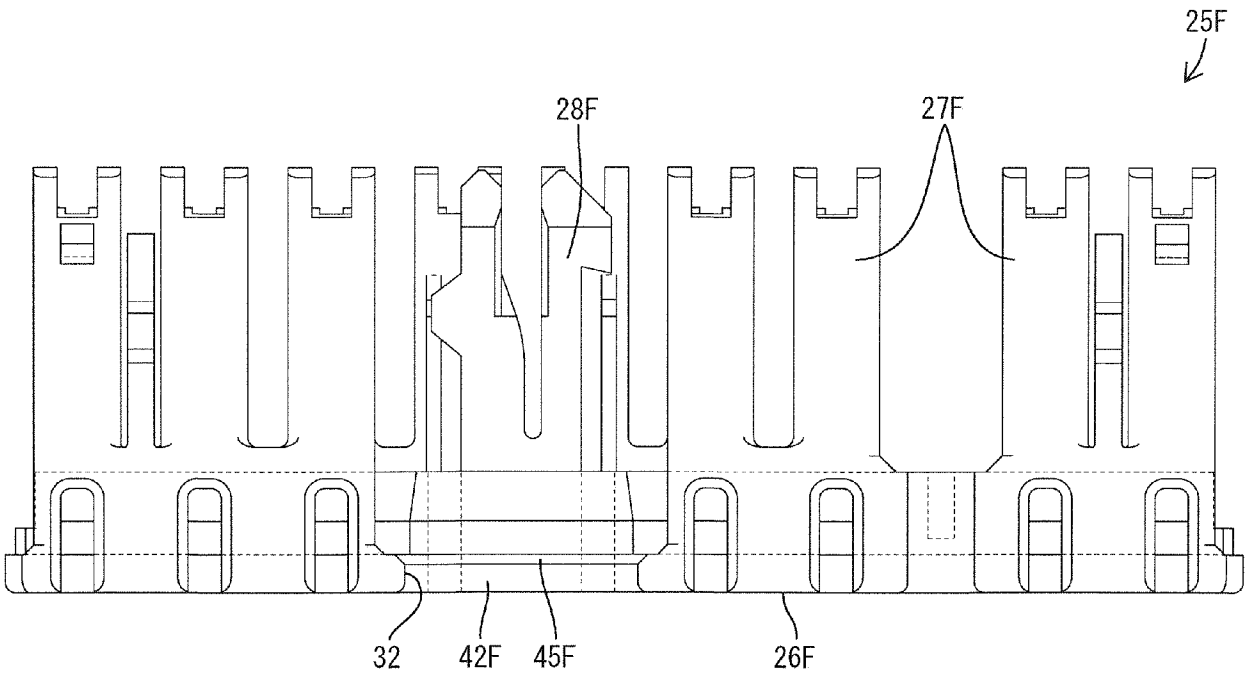
FIG. 6 is a plan view of the female front retainer.
Figure 7:
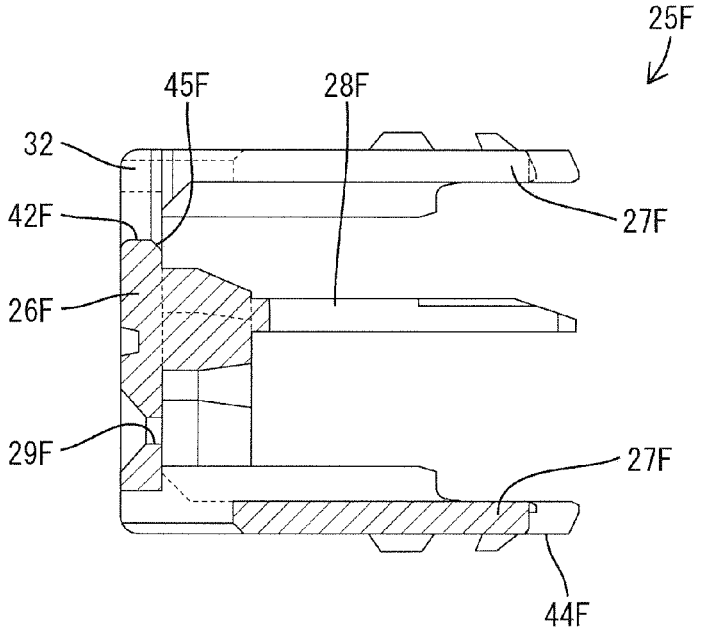
FIG. 7 is a section along B-B of FIG. 5.
Figure 8:
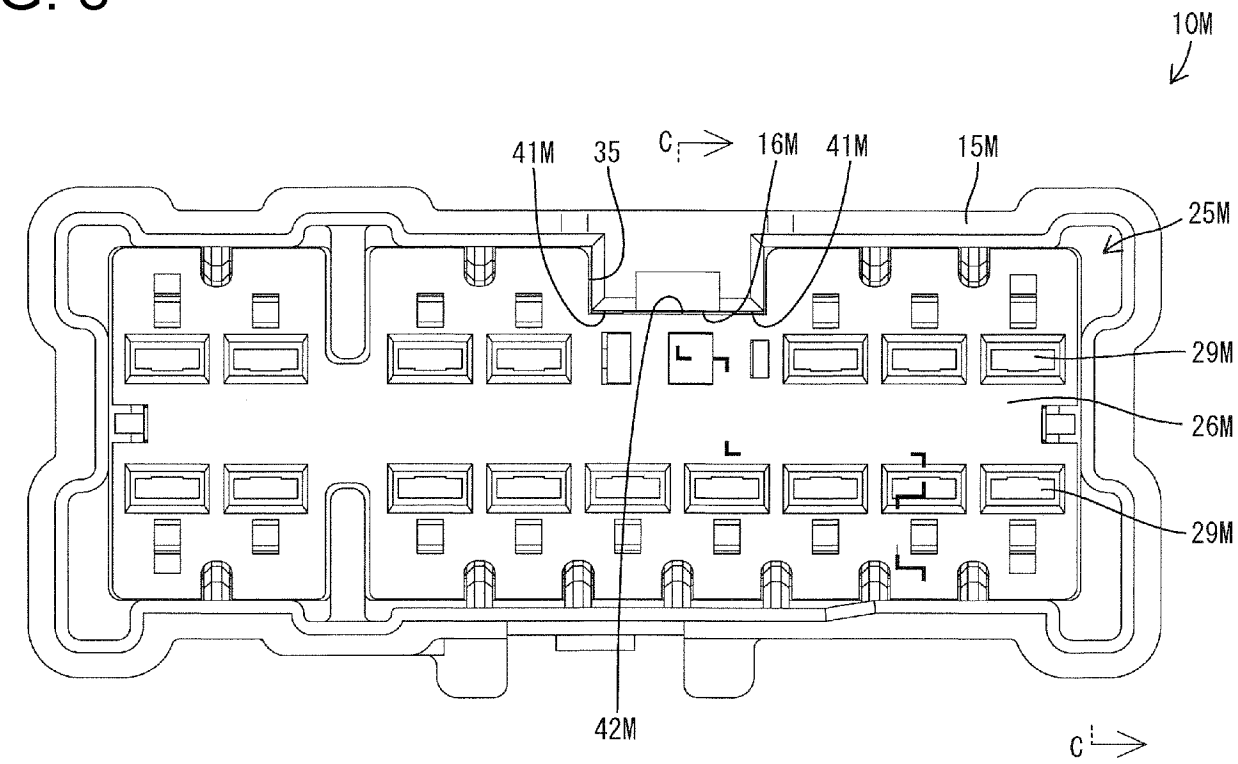
FIG. 8 is a front view of a male connector.

As shown in FIGS. 5 to 7, the female front retainer 25F is formed unitarily to include a front wall 26F, detecting portions 27F cantilevered rearward from the front wall 26F and a locking arm 28F cantilevered rearward from the front wall 26F. Receiving holes 29F penetrate through the front wall 26F at positions corresponding to the respective cavities 12F. The female front retainer 25F is assembled to the female housing 11F from the front. The assembled female front retainer 25F is held at either the partial locking position 1P (see FIG. 3) where the female front retainer 25F is assembled lightly or the full locking position 2P (see FIG. 2) where the female front retainer 25F is assembled more deeply than at the partial locking position 1P by the engagement of the locking arm 28F and the locks 18F (engaged state is not shown).

The front wall 26F is opposed to and spaced from the front surface of the female housing 11F when the female front retainer 25F is at the partial locking position 1P. Further, the detecting portions 27F are displaced forward from the locking lances 13F and the deformation spaces 14F. Thus, the locking lances 13F can be deformed toward the deformation spaces 14F and the female terminal fittings 20F can be inserted into the cavities 12F. The front wall 26F is in contact with the front surface of the female housing 11F when the female front retainer 25F is at the full locking position 2P. Further, the detecting portions 27F are inserted into the deformation spaces 14F. Thus, the locking lances 13F can no longer be deformed toward the deformation spaces 14F. In this way, the locking lances 13F are locked while engaged with the female terminal fittings 20F and the female terminal fittings 20F are retained reliably.

A female terminal fitting 20F may be left at a half-inserted position without reaching a proper insertion position in any one of the cavities 12F. In this situation, the locking lance 13F pushed by the insufficiently inserted female terminal fitting 20F remains deformed in the deformation space 14F. Accordingly, the detecting portion 27F will contact the locking lance 13F in the deformation space 14F during an attempt to push the female front retainer 25F from the partial locking position 1P to the full locking position 2P, thereby preventing any further assembly. Thus, the presence of the insufficiently inserted female terminal fitting 20F can be detected.

The female connector 10F is formed with restrictions 41F, 42F, 43F and 44F for restricting a displacement of the female front retainer 25F relative to the female housing 11F in the vertical direction crossing an assembling direction AD. A direction of displacement restriction by the restrictions 41F, 42F, 43F and 44F is the same as a resilient deforming direction of the resilient contact piece of the female terminal fitting 20F and parallel to a direction in which the resilient contact piece and the tab 22M are brought into resilient contact to produce a contact pressure.

The restrictions 41F, 42F, 43F and 44F are formed on both the female housing 11F and the female front retainer 25F. A projection 30 is formed at a front part of the lock arm 16F and projects forward from the front surface of the housing 11F. A reference surface 31 is defined at the front of the projection 30 and sets dimensions of respective parts of the female housing 11F. An upward displacement restriction 41F is defined on the lower surface of the projection 30 of the female housing 11F. On the other hand, a cutout 32 is formed on a part of the upper end edge of the front wall 26F of the female front retainer 25F corresponding to the projection 30 of the lock arm 16F and an upward displacement restriction 42F of the female front retainer 25F is defined at the upper surface of the cutout 32.

The front wall 26F is located before the projection 30 when the female front retainer 25F is at the partial locking position 1P. Therefore the upward displacement restriction 41F of the female housing 11F and the upward displacement restriction 42F of the female front retainer 25F are in a non-corresponding positional relationship in forward and backward directions parallel to an assembling direction AD of the female front retainer 25F. The front surface of the front wall 26F is substantially flush with the reference surface 31 when the female front retainer 25F is moved to the full locking position 2P and the projection 30 is fit in the cutout 32. Thus, the upward displacement restriction 41F of the projection 30 and the upward displacement restriction 42F of the front wall 26F vertically contact each other to restrict an upward displacement of the female front retainer 25F relative to the female housing 11.

Downward displacement restrictions 43F of the female housing 11F are defined at the lower surfaces of the deformation spaces 14F in the lower level. The downward displacement restrictions 43F of the deformation spaces 14F are slightly higher than the lower surfaces of spaces before the deformation spaces 14F. On the other hand, downward displacement restrictions 44F of the female front retainer 25F are defined at the lower surfaces of rear end parts of the detecting portions 27F in the lower level. The downward displacement restrictions 44F of the detecting portions 27F are slightly lower than the lower surfaces of areas before the downward displacement restrictions 44F.

The detecting portions 27F are located before the deformation spaces 14F when the female front retainer 25F is at the partial locking position 1P. Thus, the downward displacement restrictions 44F of the female front retainer 25F and the downward displacement restrictions 43F of the female housing 11F are in a non-corresponding positional relationship in forward and backward directions (parallel to the assembling direction AD of the female front retainer 25F). The detecting portions 27F enter the deformation spaces 14F when the female front retainer 25F is moved to the full locking position 2P. Thus, the downward displacement restrictions 44F of the detecting portions 27 and the downward displacement restrictions 43F of the deformation spaces 14F vertically contact each other to restrict a downward displacement of the female front retainer 25F relative to the female housing 11F.

As shown in FIG. 3, a front end part of the upward displacement restriction 41F of the projection 30 and a rear end part of the upward displacement restriction 42F of the front wall 26F are formed with guiding surfaces 45F extending in a direction oblique to the assembling direction AD of the female front retainer 25F. Front parts of the downward displacement restrictions 43F of the deformation spaces 14F and rear parts of the downward displacement restrictions 44F of the detecting portions 27F also are formed with at least one guiding surface (not shown) extending in a direction oblique to the assembling direction AD of the female front retainer 25F. Thus, the inclined guiding surfaces 45F and the restrictions 41F and 42F, 43F and 44F are brought smoothly into contact in the process of assembling the female front retainer 25F so that the female front retainer 25F can move smoothly from the partial locking position 1P to the full locking position 2P.

Figure 9:
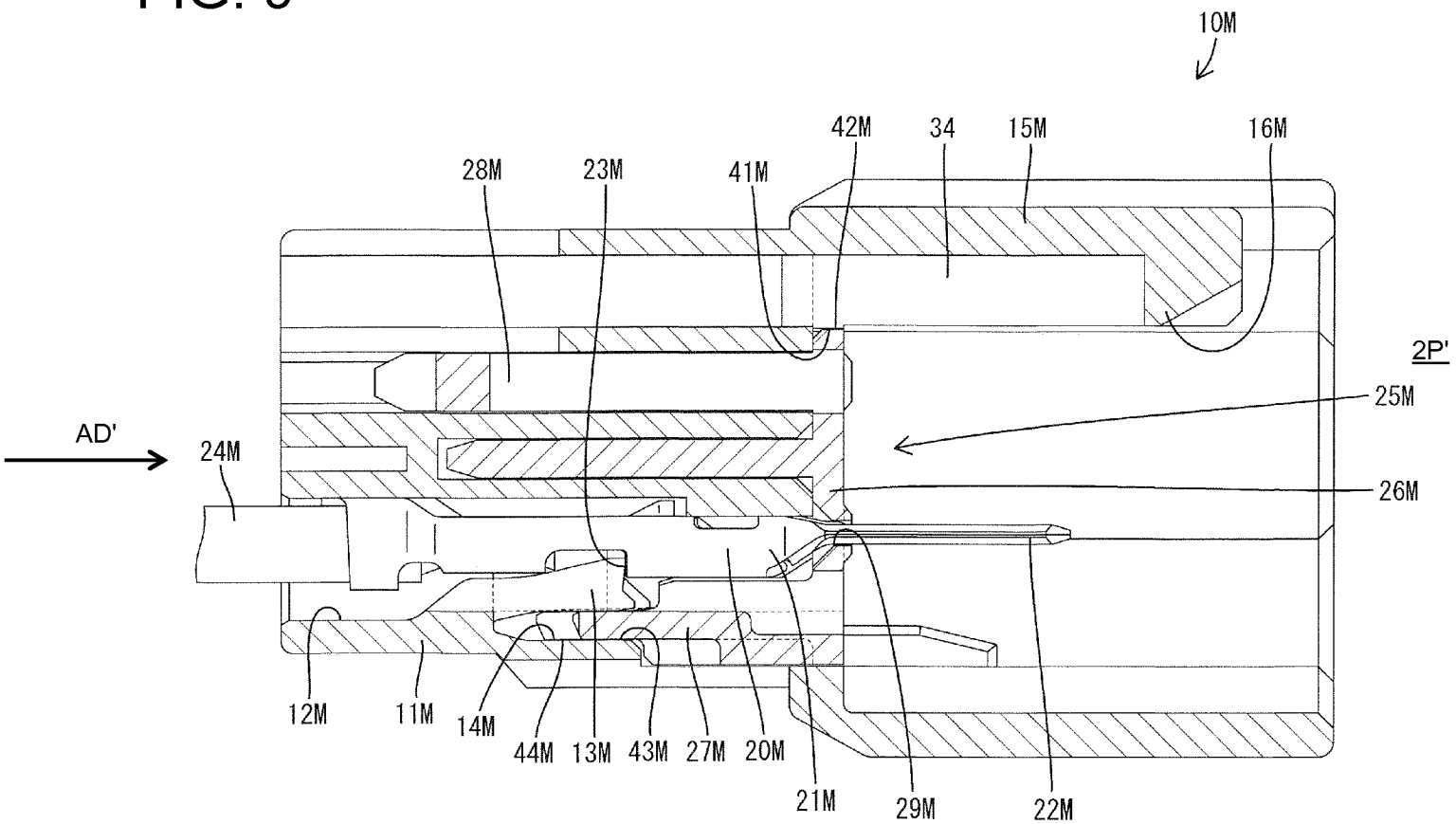
FIG. 9 is a section along C-C of FIG. 8 showing a state where a male front retainer is fully locked in a male housing.
Figure 10:
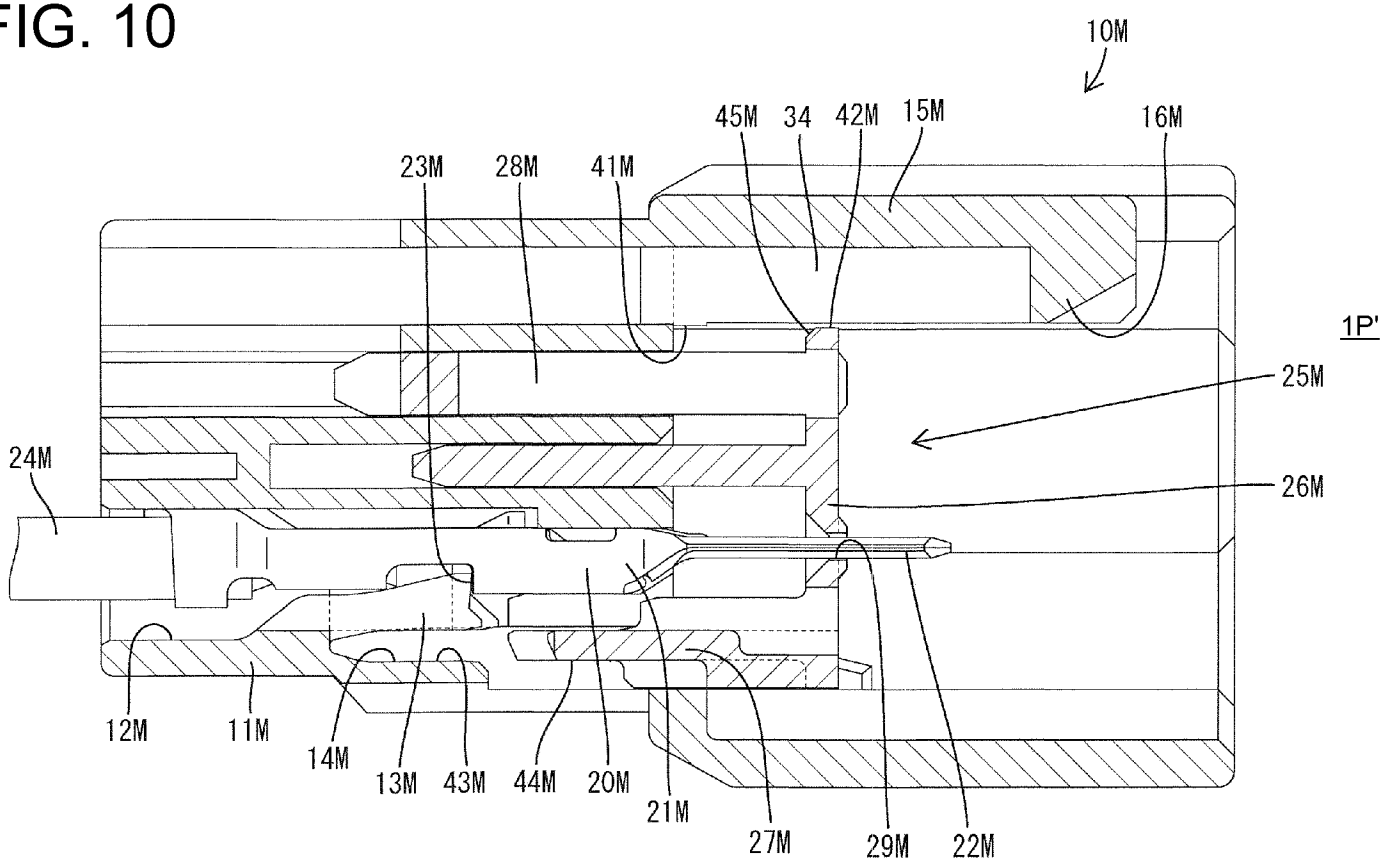
FIG. 10 is a section along C-C of FIG. 8 showing a state where the male front retainer is partly locked in the male housing.

As shown in FIGS. 9 and 10, the male connector 10M is formed by assembling the male housing 11M made e.g. of synthetic resin, male terminal fittings 20M and a male front retainer 25M made e.g. of synthetic resin.

Cavities 12M penetrate through the male housing 11M in forward and backward directions and are arranged in upper and lower levels. A locking lance (not shown) is cantilevered forward along an upper wall in each cavity 12M in the upper level. A deformation space (not shown) is defined above the locking lance in the upper level in the male housing 11M for allowing the locking lance to be deformed up and out of an insertion path for the male terminal fitting 20M in the cavity 12M. On the other hand, a locking lance 13M is cantilevered forward along a lower wall in each cavity 12M in the lower level. A deformation space 14M is defined below the locking lance 13M in the lower level for allowing the locking lance 13M to be deformed resiliently down and out of an insertion path for the male terminal fitting 20M in the cavity 12M. The deformation spaces 14M are open at the front of the male housing 11M.

Figure 11:
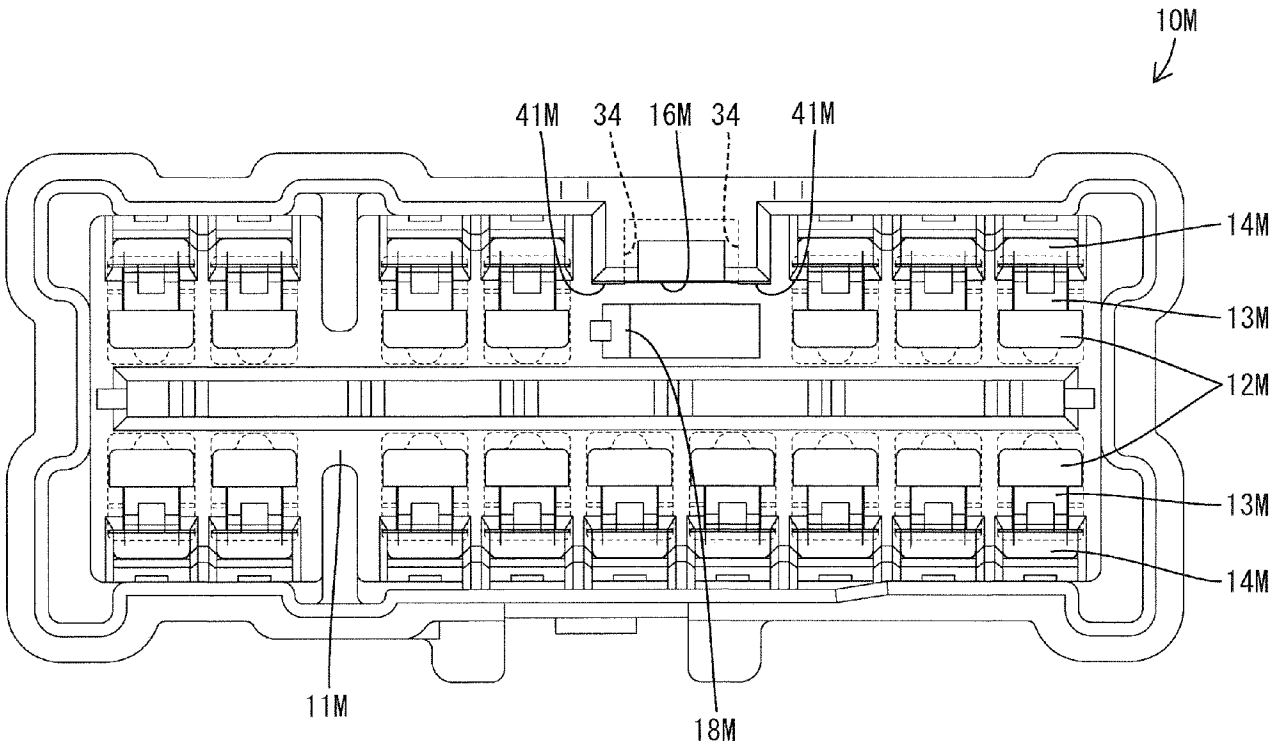
FIG. 11 is a front view of the male housing.

A rectangular tubular receptacle 15M projects forward from the outer peripheral edge of a front end part of the male housing 11M. Left and right ribs 34 extend in substantially forward and backward directions on an upper wall of the receptacle 15M and a lock projection 16M connects front end parts of the ribs 34. The lock projection 16M is at a position corresponding to the lock arm 16F in vertical and lateral directions. Further, as shown in FIG. 11, a lock 18M is formed at a position of the male housing 11M below the lock projection 16M for holding the male front retainer 25M at a partial locking position and a full locking position.

The male terminal fitting 20M is long and narrow in forward and backward directions, as shown in FIGS. 9 and 10. A rectangular tubular main body 21M is at a longitudinally intermediate position and a long narrow tab 22M projects forward from the main body 21M. A retaining portion 23M is formed at the rear edge of the main body 21M and can engage the locking lance 13M. A wire 24M is to be connected to a rear part of the male terminal fitting 20M (e.g. by crimping or soldering). The main body 21M of the male terminal fitting 20M pushes the locking lance 13M in the process of inserting the male terminal fitting 20M into the cavity 12M from behind and deforms the locking lance 13M into the deformation space 14M. The locking lance 13M resiliently returns to engage the retaining portion 23M when the male terminal fitting 20M reaches a proper insertion position and holds the male terminal fitting 20M in a retained state.

Figure 12:
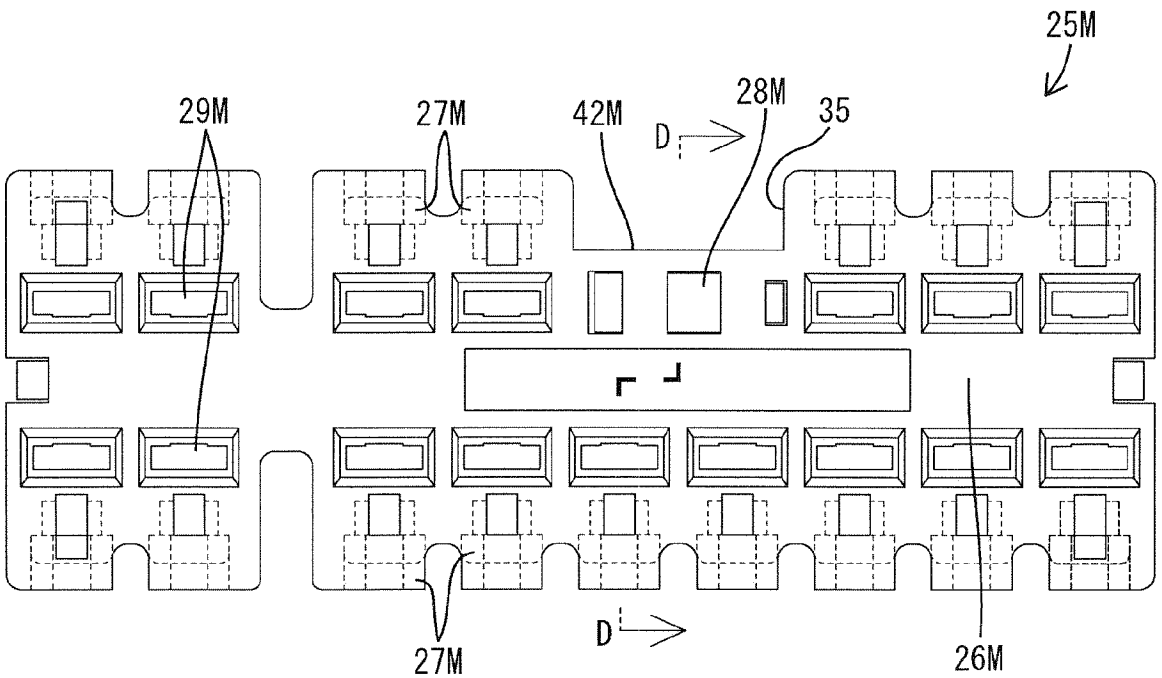
FIG. 12 is a front view of the male front retainer.
Figure 13:
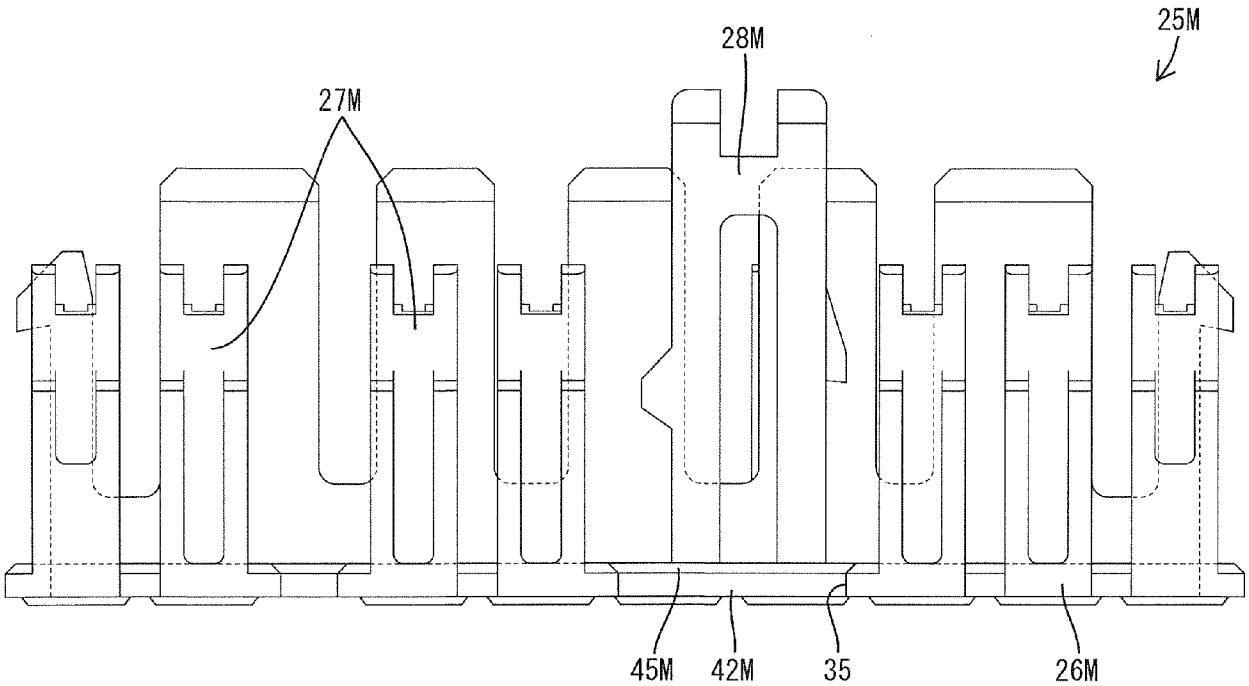
FIG. 13 is a plan view of the male front retainer.
Figure 14:
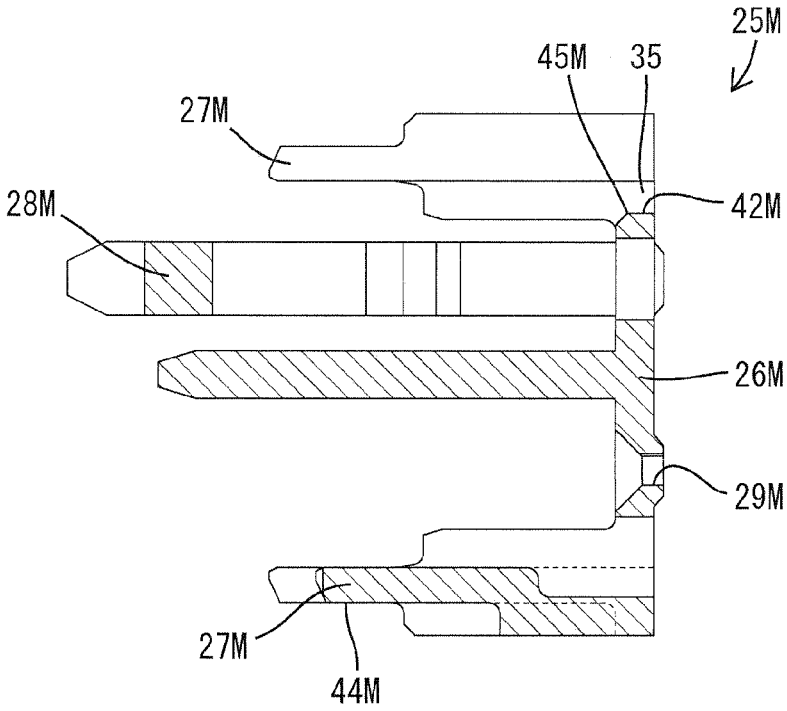
FIG. 14 is a section along D-D of FIG. 12.

As shown in FIGS. 12 to 14, the male front retainer 25M is a unitary structure with a front wall 26M, detecting portions 27M that cantilever back from the front wall 26M and a locking arm 28M that cantilevers back from the front wall 26M. Insertion holes 29M penetrate through the front wall 26M at positions corresponding to the respective cavities 12M. The male front retainer 25M is assembled to the male housing 11M from the front and can be held at either a partial locking position 1P' (see FIG. 10) where the male front retainer 25M is assembled lightly or a full locking position 2P' (see FIG. 9) where the male front retainer 25M is assembled more deeply than at the partial locking position 1P'. The locking arm 28M engages the lock 18M at the partial locking position 1P'. At either position, the tabs 22M penetrate through the insertion holes 29M at either position.

The front wall 26M is spaced from the front surface of the male housing 11M when the male front retainer 25M is at the partial locking position 1P'. Further, the detecting portions 27M are displaced forward from both the locking lances 13M and the deformation spaces 14M at the partial locking position 1P'. Thus, the locking lances 13M can be deformed toward the deformation spaces 14M and the male terminal fittings 20M can be inserted into the cavities 12M. The front wall 26M is in contact with the front surface of the male housing 11M and the detecting portions 27M are in the deformation spaces 14M when the male front retainer 25M is at the full locking position 2P'. Thus, the locking lances 13M cannot deform toward the deformation spaces 14M. In this way, the locking lances 13M are locked reliably in engagement with the male terminal fittings 20M.

One or more of the male terminal fittings 20M may not be inserted to a proper position in the respective cavity 12M. Thus, the locking lance 13M pushed by the insufficiently inserted male terminal fitting 20M remains deformed and in the deformation space 14M. An attempt could be made to push the male front retainer 25M from the partial locking position 1P' to the full locking position 2P' in this state. However, the detecting portion 27M will contact the locking lance 13M in the deformation space 14M thereby preventing assembly and indicating the presence of the insufficiently inserted male terminal fitting 20M.

This male connector 10M is formed with restrictions 41M, 42M, 43M and 44M for restricting vertical displacements of the male front retainer 25M relative to the male housing 11M in the direction crossing an assembling direction AD'. A direction of displacement restriction by the restrictions 41M, 42M, 43M and 44M is substantially parallel to a direction in which the resilient contact piece of the female terminal fitting 20F and the tab 22M are brought into contact to produce a contact pressure.

The restrictions 41M, 42M, 43M and 44M are formed on both the male housing 11M and the male front retainer 25M. Upward displacement restrictions 41M of the male housing 11M are defined on rear end parts of the lower surfaces of the ribs 34. On the other hand, a cutout 35 is formed on a part of the upper edge of the front wall 26M of the male front retainer 25M corresponding to the ribs 34 and the lock arm 16M and an upward displacement restriction 42M of the male front retainer 25M is defined on the upper surface of the cutout 35.

The front wall 26M is at a position corresponding to substantially central parts of the ribs 34 in forward and backward directions when the male front retainer 25M is at the partial locking position 1P', and the upward displacement restriction 42M of the male front retainer 25M and the upward displacement restrictions 41M of the male housing 11M are in a non-corresponding positional relationship in forward and backward directions (parallel to an assembling direction AD' of the male front retainer 25M). The male front retainer 25M then is moved to the full locking position 2P'. As a result, the front surface of the front wall 26M approaches the front surface of the male housing 11M and the upward displacement restrictions 41M of the ribs 34 and the upward displacement restriction 42M of the front wall 26M vertically contact each other to restrict upward displacement of the male front retainer 25M relative to the male housing 11.

The lower surfaces of the deformation spaces 14M in the lower level define downward displacement restrictions 43M of the male housing 11M. The downward displacement restrictions 43M of the deformation spaces 14M are slightly higher than the lower surfaces of spaces before the deformation spaces 14M. On the other hand, the lower surfaces of rear end parts of the detecting portions 27M in the lower level define downward displacement restrictions 44M of the male front retainer 25M. The downward displacement restrictions 44M of the detecting portions 27M are slightly lower than the lower surfaces of areas before the downward displacement restrictions 44M.

The detecting portions 27M are located before the deformation spaces 14M when the male front retainer 25M is at the partial locking position 1P'. Thus, the downward displacement restrictions 44M of the male front retainer 25M and the downward displacement restrictions 43M of the male housing 11M are in a non-corresponding positional relationship in forward and backward directions. However, the detecting portions 27M enter the deformation spaces 14M when the male front retainer 25M is moved to the full locking position 2P'. Thus, the downward displacement restrictions 44M of the detecting portions 27M and the downward displacement restrictions 43M of the deformation spaces 14M vertically contact each other to restrict a downward displacement of the male front retainer 25M relative to the male housing 11M.

A guiding surface 45M is formed on a rear part of the upward displacement restriction 42M of the front wall 26M and extends oblique to the assembling direction of the male front retainer 25M. Front end parts of the downward displacement restrictions 43M of the deformation spaces 14M and rear end parts of the downward displacement restrictions 44M of the detecting portions 27M also are formed with guiding surfaces extending oblique to the assembling direction AD' of the male front retainer 25M. Thus, the male front retainer 25M can move smoothly from the partial locking position 1P' to the full locking position 2P' in the process of assembling the male front retainer 25M due to the inclined guiding surface 45M and the restrictions 41M and 42M, 43M and 44M.

The female front retainer 25F is locked fully in the female housing 11F and the male front retainer 25M is locked fully in the male housing 11M when the female connector 10F and the male connector 10M are connected. The tabs 22M are inserted through the receiving holes 29F of the female front retainer 25F and into the tubes 21F of the female terminal fittings 20F in a connecting process and the lock arm 16F interferes with the lock projection 16M to deform to the unlocking position. The tabs 22M and the resilient contact pieces are brought into contact and the lock arm 16F resiliently returns to engage the lock projection 16M when the connectors 10F, 10M reach a properly connected state. The engagement of the lock arm 16F and the lock projection 16M lock the connectors 10F, 10M in the properly connected state.

The contact of the restrictions 41F and 42F, 43F and 44F during assembly of the female front retainer 25F into the female housing 11F restricts relative displacements of the female housing 11F and the female front retainer 25F in the vertical direction to prevent problems caused by these displacements. Similarly, the contact of the restrictions 41M and 42M, 43M and 44M during assembly of the male front retainer 25 into the male housing 11M restricts relative displacements of the male housing 11M and the male front retainer 25M in the vertical direction to prevent problems caused by these displacements.

The projection 30 projects forward from the front surface of the female housing 11F and has the reference surface 31 at the projecting end, which is used in setting the dimensions of the female housing 11F. The upward displacement restriction 41F is formed on the inner surface of the projection 30. Thus, the shape of the female housing 11F is more simple than if a restriction is formed on a special part.

The male housing 11M has the receptacle 15M surrounding the tabs 22M and the upward displacement restrictions 41M are formed on the inner surface of the receptacle 15M. Thus, the shape of the male housing 11M is simplified as compared with the case where restrictions are formed on a special part different from the receptacle 15M.

The detecting portions 27F, 27M fit into the deformation spaces 14F, 14M that allow deformation of the locking lances 13F, 13M. The downward displacement restrictions 43F, 44F, 43M and 44M are formed on the surfaces of the existing deformation spaces 14F, 14M facing the locking lances 13F, 13M and the outer surfaces of the existing detecting portions 27F, 27M opposite the locking lances 13F, 13M. Accordingly, the shapes of the housings 11F, 11M and the front retainers 25F, 25M can be simplified as compared with the case where restrictions are formed on special parts.

The locking lances 13F, 13M are displaced in directions to increase engagement margins with the terminal fittings 20F, 20M by contacting the downward displacement restrictions 43F and 44F, 43M and 44M while fitting the detecting portions 27F, 27M into the deformation spaces 14F, 14M. In this way, the engagement margins of the locking lances 13F, 13M and the terminal fittings 20F, 20M increase when the detecting portions 27F, 27M are fit into the deformation spaces 14F, 14M. Thus, reliability of retaining the terminal fittings 20F, 20M by the locking lances 13F, 13M is improved. That is, the restrictions 43F and 44F, 43M and 44M function to restrict displacements of the front retainers 25F, 25M relative to the housings 11F, 11M and to improve reliability of retaining the terminal fittings 20F, 20M.

The invention is not limited to the above described embodiment. For example, the following embodiments are also included in the scope of the invention.

The restrictions of the female housing are formed on the existing projection and deformation spaces in the above embodiment. However, they may be formed on special parts different from the projection and the deformation spaces.

The restrictions of the male housing are formed on the inner surface of the existing receptacle in the above embodiment. However, they may be formed on a special part different from the receptacle.

The locking lances are displaced in directions to increase the engagement margins with the terminal fittings by the contact of the restrictions while fitting the detecting portions into the deformation spaces in the above embodiment. However, the locking lances need not be displaced in directions to increase the engagement margins with the terminal fittings even if the restrictions contact with each other while fitting the detecting portions into the deformation spaces.

What is claimed is:

1. A connector, comprising:

a housing having front and rear ends and at least one cavity formed therein, and two first displacement restrictions formed on opposed inwardly facing surfaces of the housing that are fixed relative to one another and parallel to an assembly direction;

at least one terminal fitting to be inserted into the cavity in the assembling direction;

at least one locking lance disposed in the housing to be deformed and retracted out of an insertion path for the terminal fitting in the process of inserting the terminal fitting and resiliently returning to retain the terminal fitting when the terminal fitting is inserted properly into the cavity, the locking lance being spaced from the first displacement restrictions;

at least one deformation space open on the front end of the housing and allowing deformation of the locking lance; and a front retainer assembled to the front end of the housing and including a front wall substantially facing the front end of the housing in an assembled state, at least one detecting portion fit into the deformation space in the assembled state, and two oppositely facing second displacement restrictions on outwardly facing surfaces of the front retainer that are parallel to the assembly direction and fixed relative to one another;

wherein the two second displacement restrictions contact the two first displacement restrictions in directions crossing the assembling direction as the front retainer is mounted on the housing for restricting relative displacements of the housing and the front retainer in the direction crossing the assembling direction.

2. The connector of claim 1, wherein the terminal fitting is a female terminal fitting including a tube for at least partly accommodating a tab of a mating terminal fitting.

3. The connector of claim 2, wherein a projection projects forward from the front end of the housing where the cavity is open and has a projecting end surface that serves as a reference surface in setting dimensions of the housing.

4. The connector of claim 3, wherein one of the first displacement restrictions is formed on an inner surface of the projection and one of the second displacement restrictions is formed on an outer surface of the front wall.

5. The connector of claim 1, wherein:

the terminal fitting is a male terminal fitting including a tab at the front end; and the housing has a receptacle at least partly surrounding the tab.

6. The connector of claim 5, wherein one of the first displacement restrictions is formed on an inner surface of the receptacle and one of the second displacement restrictions is formed on an outer surface of the front wall.

7. The connector of claim 1, wherein one of the first displacement restrictions is formed on a surface of the deformation space substantially facing the locking lance and one of the second displacement restrictions is formed on an outer surface of the detecting portion opposed to the locking lance.

8. The connector of claim 7, wherein the locking lance is displaced in a direction to increase an engagement margin with the terminal fitting by contact of the first and second displacement restrictions in the process of fitting the detecting portion into the deformation space.

9. The connector of claim 1, wherein front end parts of at least one of the first and second displacement restrictions is formed with at least one guiding surface extending oblique to the assembling direction of the front retainer.

* * * * *